US007140308B2

(12) United States Patent
Tsai

(10) Patent No.: US 7,140,308 B2
(45) Date of Patent: Nov. 28, 2006

(54) FOLDABLE FRAME STRUCTURE FOR FOLDABLE TABLE

(75) Inventor: Frank Tsai, Taipei (TW)

(73) Assignee: Wok & Pan Ind., Inc., Guangdong (CN)

( * ) Notice: Subject to any disclaimer, the term of this patent is extended or adjusted under 35 U.S.C. 154(b) by 321 days.

(21) Appl. No.: 10/762,147

(22) Filed: Jan. 22, 2004

(65) Prior Publication Data

US 2005/0160952 A1 Jul. 28, 2005

(51) Int. Cl.
*A47B 3/083* (2006.01)
*A47B 3/00* (2006.01)

(52) U.S. Cl. ..... 108/169; 108/132

(58) Field of Classification Search ..... 108/162, 108/166, 167, 169, 129, 130, 131, 132, 115; 248/188.1, 188.6
See application file for complete search history.

(56) References Cited

U.S. PATENT DOCUMENTS 2,643,926 A * 6/1953 Pucci ..... 108/131
3,368,504 A * 2/1968 Cohen ..... 108/131
5,357,872 A * 10/1994 Wilmore ..... 108/35
5,957,061 A * 9/1999 Chang ..... 108/129
6,058,853 A * 5/2000 Pinch ..... 108/129
6,561,106 B1 * 5/2003 Tseng ..... 108/131
6,615,743 B1 * 9/2003 Nien ..... 108/132
6,823,806 B1 * 11/2004 Buono ..... 108/132
2002/0092445 A1 * 7/2002 Glover et al. ..... 108/129
2003/0005864 A1 * 1/2003 Wen ..... 108/132
2003/0167981 A1 * 9/2003 Cai ..... 108/132
2004/0031422 A1 * 2/2004 Wong ..... 108/132
2004/0094076 A1 * 5/2004 Jin ..... 108/132

* cited by examiner

*Primary Examiner*—Lanna Mai
*Assistant Examiner*—Timothy Ayres
(74) *Attorney, Agent, or Firm*—Raymond Y. Chan; David and Raymond Patent Group

(57) ABSTRACT

A foldable frame includes two U-shaped tabletop supports mounted underneath two table panels respectively, two folding hinges spacedly mounted between the two tabletop supports to pivotally connect the two tabletop supports with each other such that the tabletop is adapted to fold between a folded position that the two table panels are overlappedly folded with each other and an unfolded position that the two table panels are aligned edge-to-edge, and two leg frames foldably connected with the tabletop supports respectively. As a result, the foldable frame is capable of not only supporting the tabletop but also folding the tabletop in half so as to reduce the size of the foldable table.

12 Claims, 5 Drawing Sheets

FOLDABLE FRAME STRUCTURE FOR FOLDABLE TABLE

BACKGROUND OF THE PRESENT INVENTION

1. Field of Invention

The present invention relates to a foldable table, and more particularly to a foldable frame structure for a foldable table, which comprises two tabletop supports which are not only capable of supporting the tabletop, but also folding the tabletop in half so as to reduce the size of the foldable table for convenient storage and transportation.

2. Description of Related Arts

A conventional foldable table generally comprises a tabletop and a supporting frame which comprises a tabletop reinforcing frame and a foldable leg frame connected thereunder in a pivotally foldable manner. When the foldable is in use, the leg frame is pivotally unfolded and extended to support the tabletop at an elevated height, and when the foldable table is not in use, the leg frame is capable of being folded towards the tabletop for reduction in its overall size so as to facilitate easy storage and transportation.

Traditionally, most of the improvements for conventional foldable tables have been overwhelmingly concentrated on the leg frame. Engineers and researchers alike have devoted themselves in developing new kinds of leg frames and the foldable mechanism in order to make the foldable table easier to fold, more compact in size and more secure in structure.

Unfortunately however, it is the bulky tabletop which causes the main well-known disadvantages for conventional foldable tables. What's worse is that it seems that little efforts have been done in improving the tabletop and the supporting frame thereunder. Although it is true to say that by improving foldable mechanism of the leg frames, then it is possible to make conventional foldable tables to be more compact and optimal, by not developing the tabletop, which is the major cause of making the whole foldable table bulky and inconvenient, the core problems regarding conventional the foldable tables cannot be resolved.

Although it is conceived that by altering the structure of the tabletop may severely deteriorate the overall stability and security of the foldable table, it should not prohibit further development in an attempt to seek an optimal solution to the conventional foldable tables.

SUMMARY OF THE PRESENT INVENTION

A main object of the present invention is to provide a foldable frame structure for a foldable table, which comprises two tabletop supports which are not only capable of supporting the tabletop, but also folding the tabletop in half so as to reduce the size of the foldable table for convenient storage and transportation.

Another object of the present invention is to provide a foldable frame structure for a foldable table, which is capable of supporting a tabletop in a foldably movable manner without affecting the stability of the foldable table.

Another object of the present invention is to provide a foldable frame structure for a foldable table, which does not involve complicated and expensive mechanical components and processes so as to minimize the manufacturing cost and the ultimate selling price of the present invention.

Another object of the present invention is to provide a foldable frame structure for a foldable table, which does not significantly alter the structural design of the conventional foldable table so that the present invention is easy to operate and ready to substitute the conventional foldable tables.

Accordingly, in order to accomplish the above objects, the present invention provides a foldable table, comprising:

a tabletop which comprises two table panels; and a foldable frame, which comprises:

two tabletop supports mounted underneath the two table panels respectively, wherein each of the table supports, having a U-shaped, has two longitudinal supports extended along two longitudinal edge portions of the respective table panel and a transverse support integrally extended between the two longitudinal supports to extend along an inner transverse edge portion of the respective table panel;

two folding hinges spacedly mounted between the two tabletop supports to pivotally connect the two tabletop supports with each other such that the tabletop is adapted to fold from a folded position that the two table panels are overlappedly folded with each other to an unfolded position that the two table panels are aligned edge-to-edge; and two leg frames foldably connected with the tabletop supports respectively, wherein each of the leg frames comprises a standing leg having an upper portion pivotally connected to the respective tabletop support and a retaining frame pivotally coupling with the standing leg to retain the standing leg at a position that the standing leg is pivotally and perpendicularly folded to the respective table panel while the standing leg is adapted to pivotally fold to rest on the respective table panel.

These and other objectives, features, and advantages of the present invention will become apparent from the following detailed description, the accompanying drawings, and the appended claims.

DETAILED DESCRIPTION OF THE PREFERRED EMBODIMENT

Figure 1:
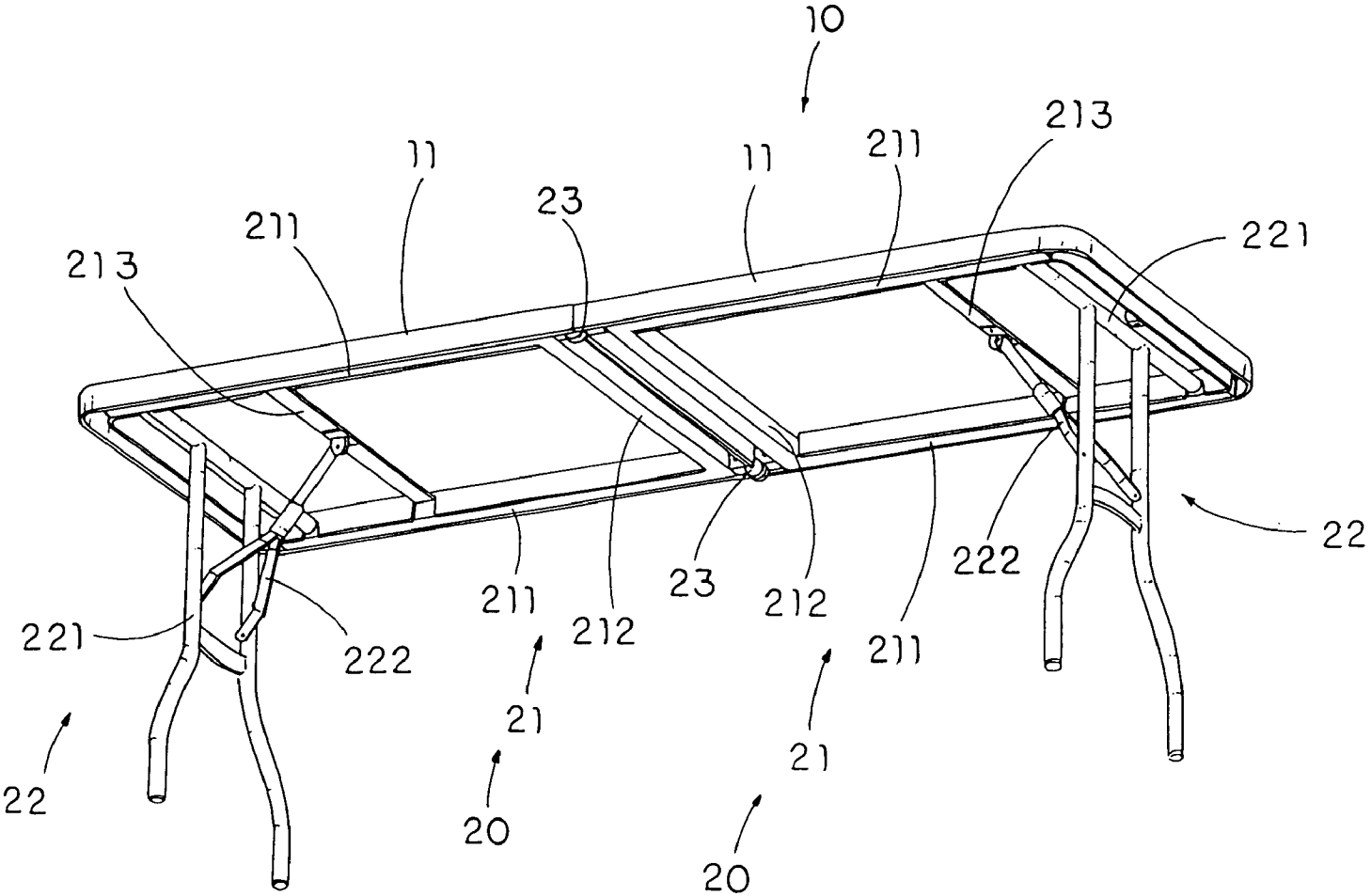
FIG. 1 is perspective view of a foldable table according to a preferred embodiment of the present invention.
Figure 2:
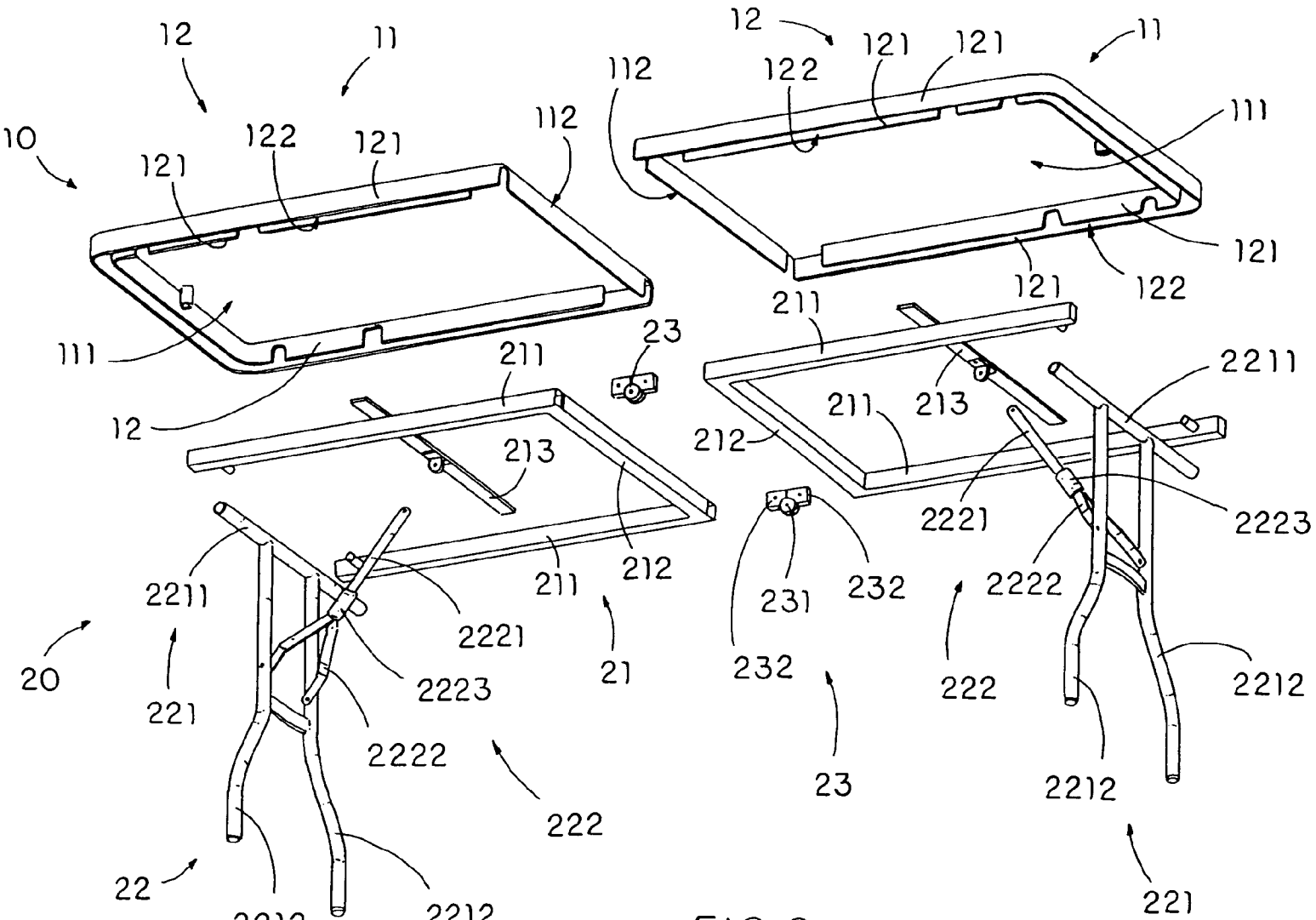
FIG. 2 is an exploded perspective view of the foldable table according to the above preferred embodiment of the present invention.

Referring to FIG. 1 and FIG. 2 of the drawings, a foldable table 1 according to a preferred embodiment of the present invention is illustrated, wherein the foldable table 1 comprises a tabletop 10 and a foldable frame 20 foldably mounted underneath the tabletop 10.

The tabletop 10 comprises two table panels 11 each having a rectangular shape and an upper utility surface formed on the respective table panel 11 for a supporting a wide variety of objects. The table panels 11 are preferably embodied as being made of strong yet light materials, such as plastic materials or composites, so as to on the one hand, securely support the things on top of the utility surface, and on the other hand, minimize the burden imposed on the foldable frame 20 and facilitate easy transportation.

As shown in FIG. 2, each of the table panels 11 has an inner transverse biasing wall 112 arranged in such a manner that when the table panels 11 are folded at the unfolded position, the two biasing walls 112 of the table panels 11 are biased with each other to align the two table panels 11 side-by-side so as to block up a further pivot movement of the tabletop 10.

The foldable frame 20 comprises two tabletop supports 21 mounted underneath the two table panels 11 respectively for substantially supporting and reinforcing the two table panels 11. Each of the tabletop supports 21 has two longitudinal supports 211 extended along two longitudinal side portions of the respective table panel 11 in parallel, and a transverse support 212 integrally extended between the two longitudinal supports 211 to extend along an inner transverse edge portion of the respective table panel 11 to define a U-shaped table support 21 formed by the longitudinal supports 211 and the transverse support 212.

In other words, the two tabletop supports 21 are opposedly mounted underneath the two table panels 11 respectively wherein each of the U-shaped tabletop supports 21 is adapted to substantially and evenly support a loading on the respective table panel 11.

Figure 3:
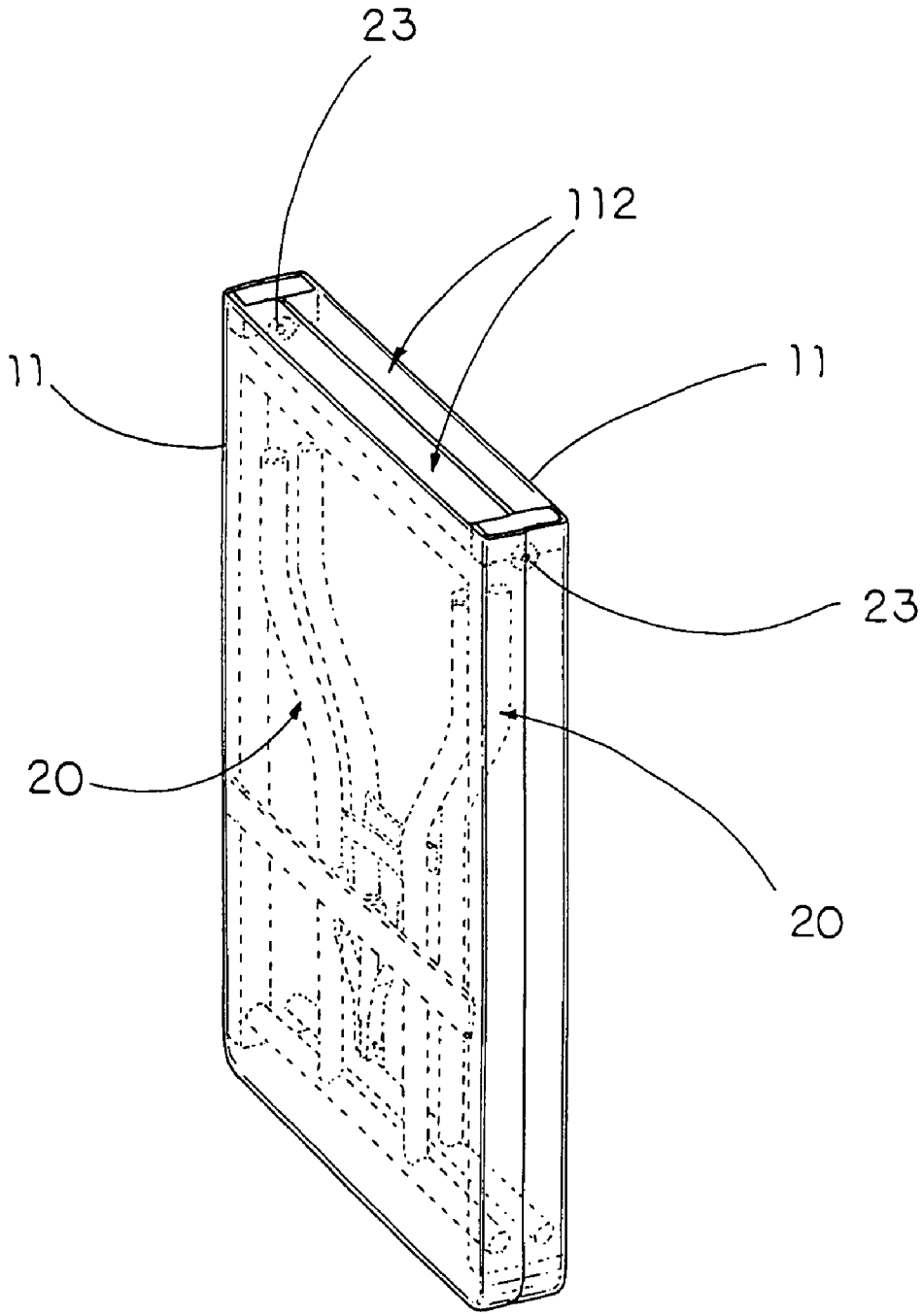
FIG. 3 is a schematic diagram of the foldable table according to the above preferred embodiment of the present invention, illustrating that the foldable table being folded in a folded position.

The foldable frame 20 further comprises two folding hinges 23 spacedly mounted between the two tabletop supports 21 to pivotally connect the two tabletop supports 21 with each other in such a manner that the tabletop 10 is adapted to fold from a folded position to an unfolded position, wherein in the folded position, as shown in FIG. 3 of the drawings, the two table panels 11 are overlappedly and pivotally folded with each other so as to reduce the overall foldable table 1 into a compact size for easy storage and transportation, as shown in FIG. 3, wherein in the unfolded position, the table panels 11 are pivotally extended to align in a side-by-side manner so that the upper utility surfaces of the two table panels 11 are substantially aligned.

It is worth to mention that when the tabletop 10 is in the unfolded position, the two table panels 11 are pivotally unfolded and aligned side-by-side so that each of the table panels 11 is arranged to bias against each other in their respective inner transverse edge portions, such that they are interlocked to retain in position.

According to the preferred embodiment, each of the folding hinges 23 is mounted between two inner ends of the corresponding longitudinal supports 211 so as to connect the two tabletop supports 21 in a pivotally foldable manner. Each of the folding hinges 23 comprises a pivot hinge 231 and two hinge arms 232 opposedly extended from the pivot hinge 231 to securely connect to two inner ends of the two corresponding longitudinal supports 211 of the tabletop supports 21 respectively so as to pivotally connect the two tabletop supports 21.

The foldable frame 20 further comprises two leg frames 22 mounted underneath the two tabletop supports 21 respectively in a pivotally foldable manner, wherein each of the leg frames 22 comprises a standing leg 221 having an upper transverse portion 2211 pivotally connected to the respective tabletop support 21, and a retaining frame 222 pivotally coupling the respective standing leg 221 with the respective tabletop support 21 so as to retain the standing leg 221 at a standing position where the standing leg 221 is arranged to be pivotally and perpendicularly extended to stand on a ground surface, and at a resting position where the standing leg 221 is pivotally fold to rest on a bottom side of the respective table panel 11.

Moreover, each of the standing leg 221 has two leg members 2212 downwardly and integrally extended from the upper transverse portion 2211 of the standing leg 221 so as to form a support on the foldable table 1 on the ground surface. In other words, the two leg frames 22 form four supports for the foldable table 1 so as to securely support the tabletop 10 at an elevated above the ground surface.

Figure 4:
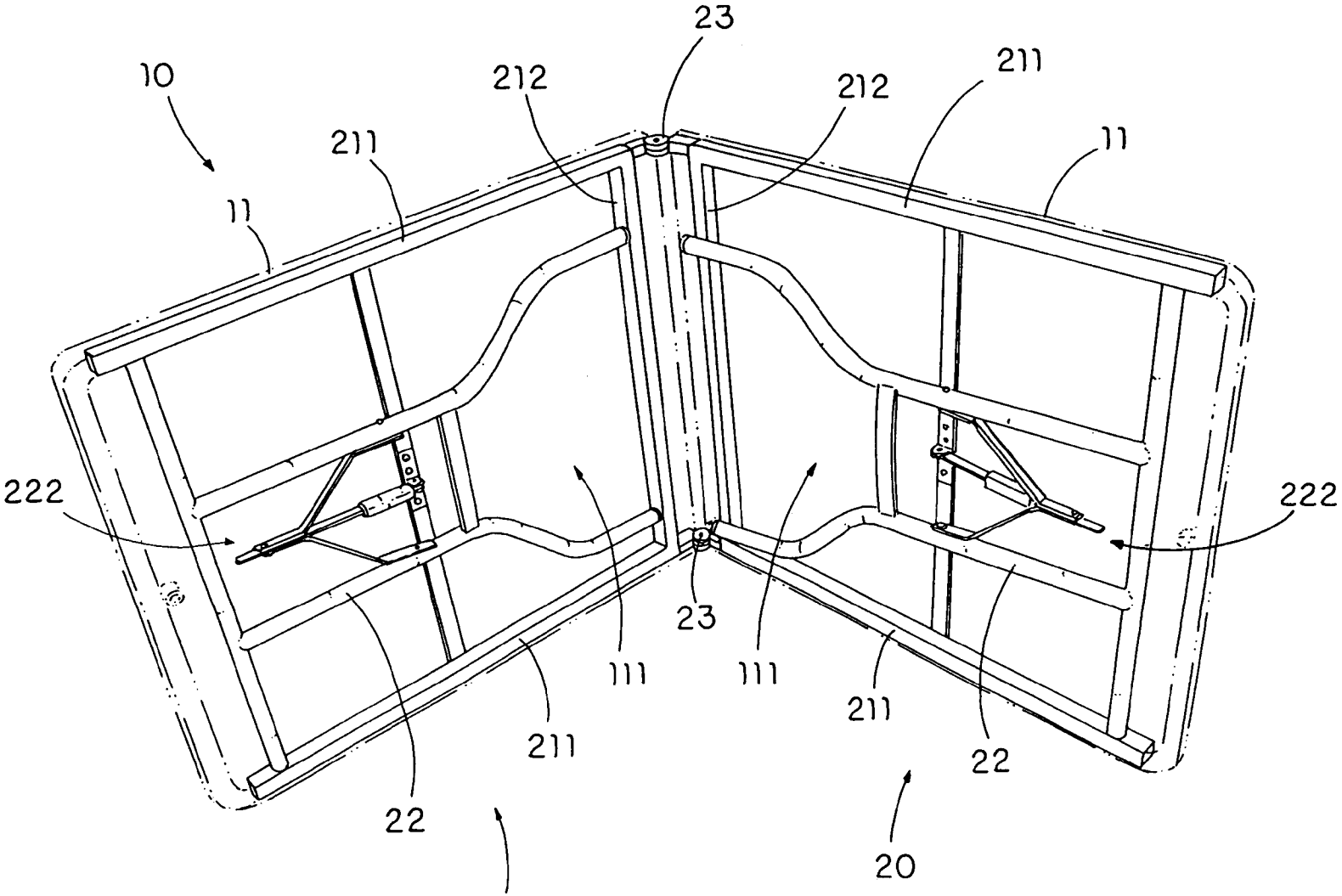
FIG. 4 is a schematic diagram of the foldable table according to the above preferred embodiment of the present invention, illustrating that the folding movement of the foldable table.

Referring to FIGS. 2 and 4, each of the tabletop supports 21 further comprises a connecting member 213 disposed within the longitudinal supports 211 to support the respective standing leg 221 in position.

Each of the connecting members 213 is transversely mounted between the two longitudinal supports 211 of the respective tabletop support 21 at a position between the standing leg 221 and the transverse support 212, wherein each of the retaining frame 222 has a leg coupling end pivotally connected to the connecting member 213 and a table coupling end pivotally connected to the connecting member 213 so as to retain the standing leg 221 at the standing position.

Figure 5:
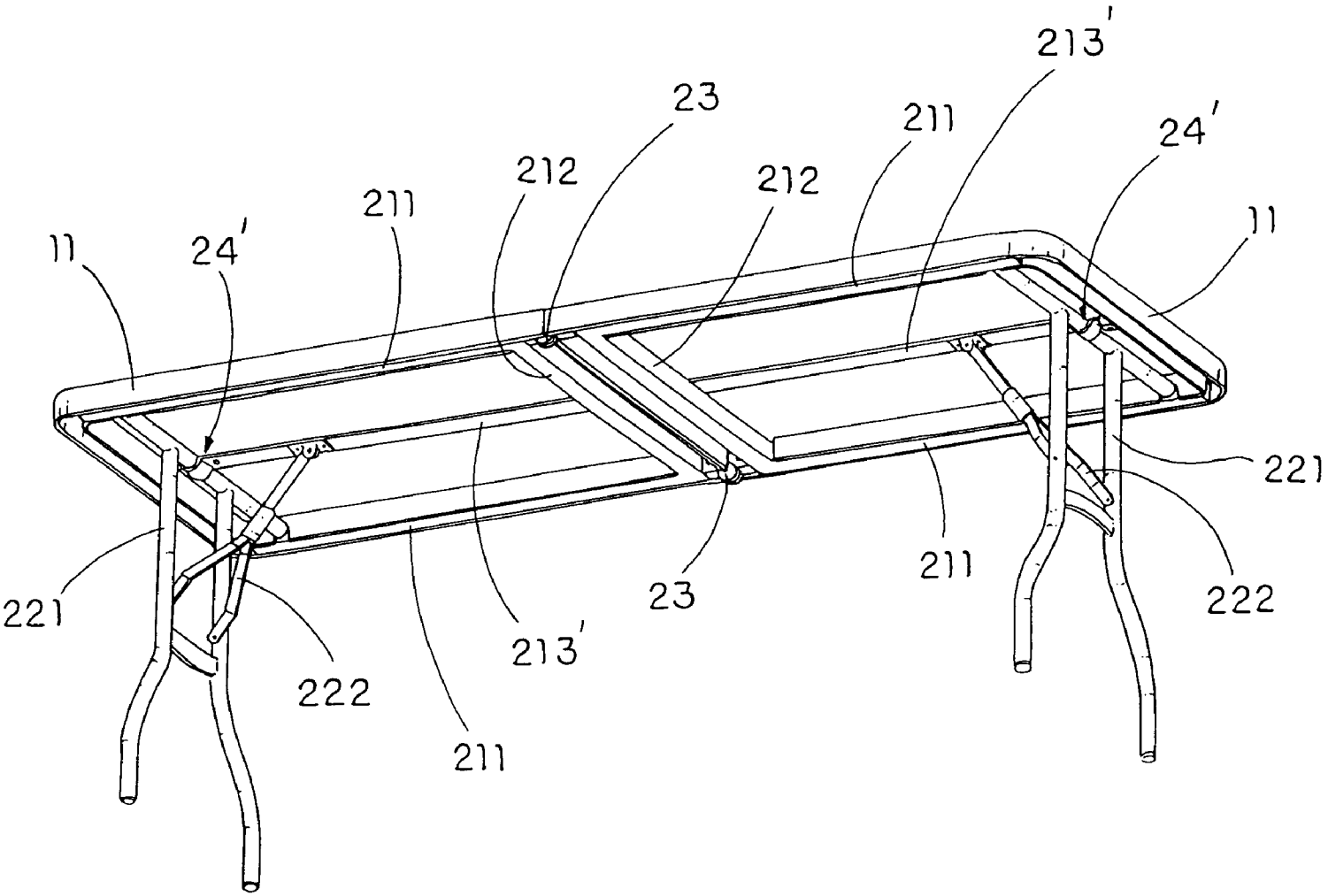
FIG. 5 is an alternative mode of the foldable table according to the above preferred embodiment of the present invention.

Alternatively, each of said connecting members 213' is longitudinally extended between the longitudinal support 211, wherein the connecting member 213' has one end rotatably connected to the respective standing leg 221 and another opposed end securely connected to the transverse support 212, as shown in FIG. 5.

In other words, the connecting member 213' is longitudinally extended from the respective transverse support 212 to the respective upper transverse portion 2211 of the respective standing leg 221 via a pivot joint 24'. As a result, the table coupling end of each of the retaining frames 222 is pivotally connected to the respective connecting member 213' and the leg coupling end of each of the retaining frames 222 is pivotally connected to the respective standing leg 221 while the standing leg 221 is capable of pivotally moving about the two longitudinal supports 211 so as to move between the resting position and the standing position, as shown in FIG. 5.

As shown in FIG. 2, each of the retaining frames 222 comprises a linking member 2221 defining the table coupling end pivotally connected to the connecting member 213 of the respective tabletop support 21, and a pair of pivotal arms 2222 which is pivotally connected to the linking member 2221 with the respective standing leg 221 and defines the leg coupling end to pivotally connect with the standing leg 221, in such a manner that the leg frame 22 is capable of pivotally folding between the standing position and the resting position.

Moreover, each of the retaining frame 222 further comprises means for retaining the retaining frame in the standing position, wherein the retaining means comprises a tubular lock 2223 slidably attached on the linking member 2221 in such a manner that when the leg frame 22 is in the standing position, the tubular lock 2223 is arranged to downwardly slide along the linking member 2221 so as to receive the upper end portions of the pivotal arms 2222 for restricting further pivotal movements thereof.

It is worth to mention that when the foldable table 1 is unfolded to stand on a ground surface, downward gravitational force will pull the tubular locks 2223 sliding downwardly along the linking members 2221 respectively so as to automatically retain the leg frames 22 in the standing position.

As shown in FIG. 2, each of the table panels 11 comprises two longitudinal rims 12 longitudinally extended from the longitudinal edge portions of the respective table panel 11, wherein each of the longitudinal rims 12 has two supporting walls 121 downwardly extended from the bottom side of the respective table panel 11 to define a support channel 122 between the two supporting walls 121 to receive the respective longitudinal support 211 of the tabletop support 21 so as to retain the longitudinal support 211 under the table panel 11 in position.

Each of the table panels 11 has a receiving cavity 111 formed within the two longitudinal rims 12 and the bottom side of said table panel 11, wherein each of the receiving cavity 111 has a predetermined depth to receive the respective standing leg 221 therein so as to overlappedly fold the table panels 11 with each other.

Moreover, a height of each of the standing legs 221 of each of the leg frames 22 should be shorter than a length of the respective longitudinal support 211 such that the leg frame 22 is adapted to pivotally folding towards and being received within the respective tabletop support 21 to rest on the bottom side of the table panel 11. Therefore, the two tabletop supports 21 are capable of pivotally and overlappedly folding towards each other into the folded position.

According to the preferred embodiment, the operation of the present invention is as follows: when the foldable table 1 is to be utilized, a user is able to unfold the tabletop 10 by pivotally folding the two table panels 11 at an alignment that the two table panels 11 are extended side by side. Then, the user is able to pivotally fold the leg frames 22 from the receiving cavities 111 to perpendicularly extend from the table panels 11 respectively. Since the leg frames 22 and the table panels 11 are locked and retained in position, the foldable table 1 is capable of providing a secure support to the objects disposed on the utility surface.

Conversely, when the foldable table 1 is folded to be stored, the user can sequentially fold the leg frames 22 and then the tabletop 10 to reduce the foldable table into a compact structure, as shown in FIGS. 3 and 4.

It is important to point out that each table panel 11 is evenly and securely reinforced and supported by the respective tabletop supports 21 yet the tabletop 10 is foldable to become a compact structure, thus substantially resolving the inherent tension that foldable structures are generally not secure enough.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable table, comprising:

a plastic tabletop comprising two table panels, wherein each of said table panels has two longitudinal edge portions and an inner transverse edge portion; and a foldable frame, which comprises:

a pair of U-shaped tabletop supports mounted underneath said two table panels respectively, wherein each of said table supports has two longitudinal supports extended along said two longitudinal edge portions of said respective table panel and a transverse support integrally extended between said two longitudinal supports to extend along said inner transverse edge portion of said respective table panel;

two folding hinges spacedly mounted between said two tabletop supports to pivotally connect said two tabletop supports with each other such that said tabletop is adapted to fold from a folded position that said two table panels are overlappedly folded with each other to an unfolded position that said two table panels are aligned edge-to-edge;

two connecting members coupling with said tabletop supports underneath said table panels respectively, wherein each of said connecting members is transversely mounted between said two longitudinal supports of said respective tabletop support; and two leg frames foldably connected with said tabletop supports respectively, wherein each of said leg frames comprises a standing leg having an upper portion pivotally connected to said respective tabletop support, and a retaining frame having a leg coupling end pivotally coupling with said respective standing leg and a table coupling end pivotally connecting to said respective connecting member to retain said standing leg at a standing position that said standing leg is pivotally and perpendicularly folded to said respective table panel while said standing leg is adapted to pivotally fold to rest on a bottom side said respective table panel, wherein each of said connecting members is positioned between said respective standing leg and said respective transverse support of said tabletop support.

2. The foldable table, as recited in claim 1, wherein each of said table panels comprises two longitudinal rims longitudinally extended from said longitudinal edge portions of said respective table panel, wherein each of said longitudinal rims has two supporting walls downwardly extended from said bottom side of said respective table panel to define a support channel between said two supporting walls to receive said respective longitudinal support of said tabletop support so as to retain said longitudinal support under said table panel in position.

3. The foldable table, as recited in claim 2, wherein each of said table panels has a receiving cavity formed within said two longitudinal rims and said bottom side of said table panel, wherein each of said receiving cavity has a predetermined depth to receive said respective standing leg therein so as to overlappedly fold said table panels with each other.

4. The foldable table, as recited in claim 1, wherein each of said folding hinges comprises a pivot hinge and two hinge arms opposedly extended from said pivot hinge to securely connect to two inner ends of said two corresponding longitudinal supports of said tabletop supports respectively so as to pivotally connect said two tabletop supports.

5. The foldable table, as recited in claim 2, wherein each of said folding hinges comprises a pivot hinge and two hinge arms opposedly extended from said pivot hinge to securely connect to two inner ends of said two corresponding longitudinal supports of said tabletop supports respectively so as to pivotally connect said two tabletop supports.

6. The foldable table, as recited in claim 3, wherein each of said folding hinges comprises a pivot hinge and two hinge arms opposedly extended from said pivot hinge to securely connect to two inner ends of said two corresponding longitudinal supports of said tabletop supports respectively so as to pivotally connect said two tabletop supports.

7. The foldable table, as recited in claim 1, wherein a height of said respective standing leg is shorter than a length of said longitudinal support such that said standing leg is adapted to pivotally folded within said respective tabletop support to rest on said respective table panel so as to overlappedly fold said table panels with each other.

8. The foldable table, as recited in claim 3, wherein a height of said respective standing leg is shorter than a length of said longitudinal support such that said standing leg is adapted to pivotally folded within said respective tabletop support to rest on said respective table panel so as to overlappedly fold said table panels with each other.

9. The foldable table, as recited in claim 6, wherein a height of said respective standing leg is shorter than a length of said longitudinal support such that said standing leg is adapted to pivotally folded within said respective tabletop support to rest on said respective table panel so as to overlappedly fold said table panels with each other.

10. The foldable table, as recited in claim 1, wherein each of said table panels has an inner transverse biasing wall configured that when said table panels are folded at said unfolded position, said two biasing walls of said table panels are biased with each other to align said two table panels side-by-side so as to block up a further pivot movement of said tabletop.

11. The foldable table, as recited in claim 6, wherein each of said table panels has an inner transverse biasing wall configured that when said table panels are folded at said unfolded position, said two biasing walls of said table panels are biased with each other to align said two table panels side-by-side so as to block up a further pivot movement of said tabletop.

12. The foldable table, as recited in claim 9, wherein each of said table panels has an inner transverse biasing wall configured that when said table panels are folded at said unfolded position, said two biasing walls of said table panels are biased with each other to align said two table panels side-by-side so as to block up a further pivot movement of said tabletop.

* * * * *